US005348637A

United States Patent [19]

Kobayashi et al.

[11] Patent Number: 5,348,637

[45] Date of Patent: Sep. 20, 1994

[54] SURFACE TREATMENT APPARATUS FOR WORKPIECES

[75] Inventors: Hisamine Kobayashi; Takeo Suzuki; Katsuhiro Izuhara, all of Nagoya, Japan

[73] Assignee: Tipton Corp., Nagoya, Japan

[21] Appl. No.: 124,641

[22] Filed: Sep. 22, 1993

[51] Int. Cl.[5] ..... C25D 17/26; C25D 17/10

[52] U.S. Cl. ..... 204/213; 204/222; 204/237; 204/287; 204/284

[58] Field of Search ..... 204/212-214, 204/287, 237, 222, 284

[56] References Cited

U.S. PATENT DOCUMENTS

| | | | |
|---|---|---|---|
| 1,583,930 | 5/1926 | Jantz et al. | 204/214 |
| 2,016,446 | 10/1935 | Merkenschlager | 204/213 |
| 2,853,447 | 9/1958 | Hackenburg | 204/214 |
| 3,862,745 | 1/1975 | Chiz | 204/287 X |
| 4,571,291 | 2/1986 | Schell et al. | 204/213 |
| 4,994,163 | 2/1991 | Lin | 204/213 |

*Primary Examiner*—Donald R. Valentine
*Attorney, Agent, or Firm*—Wenderoth, Lind & Ponack

[57] ABSTRACT

A barrel polishing machine includes an electrically conductive inner container for containing workpieces, the inner container having a number of holes formed in a circumferential wall thereof so that an electrolyte supplied to the workpieces passes through the holes, an electrically conductive outer container disposed to surround the inner container with a predetermined gap between them, a pair of electrode terminals connected to the inner and outer containers respectively so that the containers serve as electrodes with polarity opposite each other, respectively, an insulator interposed between the inner and outer containers with a predetermined gap between the same and each container, and a drive source supplying a rotational or vibratory force to the inner container. The gap between the inner and outer containers is 10 millimeters long or below. The barrel polishing machine may be diverted to an electroplating machine when the polarity is inverted.

12 Claims, 8 Drawing Sheets

SURFACE TREATMENT APPARATUS FOR WORKPIECES

BACKGROUND OF THE INVENTION

1. Field of the Invention

This invention relates to an apparatus for surface treatment by electrolytic polishing or electroplating for workpieces contained in a barrel container.

2. Description of the Prior Art

In known apparatus for barrel polishing, the polishing is performed by abrasion of workpieces with an abrasive. Prior art has provided an electrolytic barrel polishing apparatus wherein the conventional barrel polishing apparatus is provided with anode and cathode plates so that an electrochemical polishing can be performed together with the above-described polishing by the abrasion. Japanese Published Patent Application (Kokoku) No. 45-26360 (1970) and 46-9916 (1971) each discloses such a electrolytic barrel polishing apparatus. In the disclosed apparatus, an anode and a cathode are disposed in the barrel so as to be away from each other and an electric circuit is made so that workpieces serve as the anode.

The workpieces are usually caused to serve as the anode in the electrolytic polishing. On the contrary, when the workpieces are caused to serve as the cathode, an electroplating can be performed. Thus, the electrolytic polishing is a technique closely related to the electroplating. The prior art has provided for several types of electroplating apparatus employing a barrel. For example, Japanese Published Utility Model Registration Application (Kokoku) No. 56-55252 (1981) discloses one of such electroplating apparatus employing the barrel. In the disclosed apparatus, a tub vibratory machine is supported by springs. A cathode plate is provided in the barrel so that a distal end thereof reaches the barrel bottom where the workpieces are reserved while an anode plate is hung to be opposed to the cathode plate.

Supplying a large current to the workpieces with voltage drop between electrodes is an important factor from the viewpoints of treatment efficiency and consumed electric power. However, the anode and cathode plates are disposed in the barrel to be away from each other in the abovedescribed conventional apparatus. Accordingly, the current necessary for the electrolytic polishing or the electroplating cannot be obtained unless the supplied voltage is increased. That is, a desired polishing quality such as the gloss, deburring or thickness of plated coating cannot be obtained within a predetermined period of time when a small current is supplied to the apparatus. However, the temperature of the electrolyte is raised by a Joule's heat when an excessively high voltage is applied.

SUMMARY OF THE INVENTION

Therefore, an object of the present invention is to provide a surface treatment apparatus for workpieces, wherein electric energy saving and an improvement in the quality of treated workpieces can be achieved.

The present invention provides a surface treatment apparatus for workpieces, comprising an electrically conductive inner container for containing workpieces, the inner container having a number of apertures formed in a circumferential wall thereof so that an electrolyte supplied to the workpieces passes through the holes, an electrically conductive outer container disposed to surround the inner container coaxially therewith with a predetermined gap therebetween, a pair of electrode terminals connected to the inner and outer containers respectively so that the containers serve as electrodes with polarity opposite each other, respectively, an insulator interposed between the inner and outer containers with a predetermined gap between the same and each container, and a drive source supplying a rotational or vibratory force to the both containers.

According to the above-described construction, the workpieces are put into the inner container together with the electrolyte and conductive media, if necessary. The inner and outer containers are then connected to the electrodes in accordance with the kind of treatment. The inner and outer containers are connected to the anode and the cathode respectively in the case of the electrolytic polishing while the inner and outer containers are connected to the cathode and the anode respectively in the case of the electroplating. In the electrolytic polishing, the surfaces of the workpieces adjacent the inner wall of the inner container are finished by a metal removal action due to anode dissolution. In the electroplating, metal ions in the electrolyte are electrically deposited on the surfaces of the workpieces such that coatings are formed on the workpiece surfaces.

The distance between the electrodes is short since the inner and outer containers are opposed to each other with the small gap between them. Accordingly, since an anode-cathode impedance is small, a large current is supplied even when the voltage is low. Consequently, the electrolytic polishing or electroplating performance can be improved and the heating of the electrolyte can be restricted.

The apparatus may further comprise electrolyte supply means for showering the electrolyte on the workpieces. In the treatment, the electrolyte is showered on the workpieces. Consequently, the current concentration per amount of electrolyte in the unit of current density can be increased, which further improves the treatment efficiency.

Other objects of the present invention will become obvious upon understanding of the illustrative embodiments about to be described with reference to the accompanying drawings. Various advantages not referred to herein will occur to those skilled in the art upon employment of the invention in practice.

BRIEF DESCRIPTION OF THE DRAWINGS

Several embodiments of the invention will be described with reference to the accompanying drawings, in which.

DESCRIPTION OF THE PREFERRED EMBODIMENTS

Figure 1:
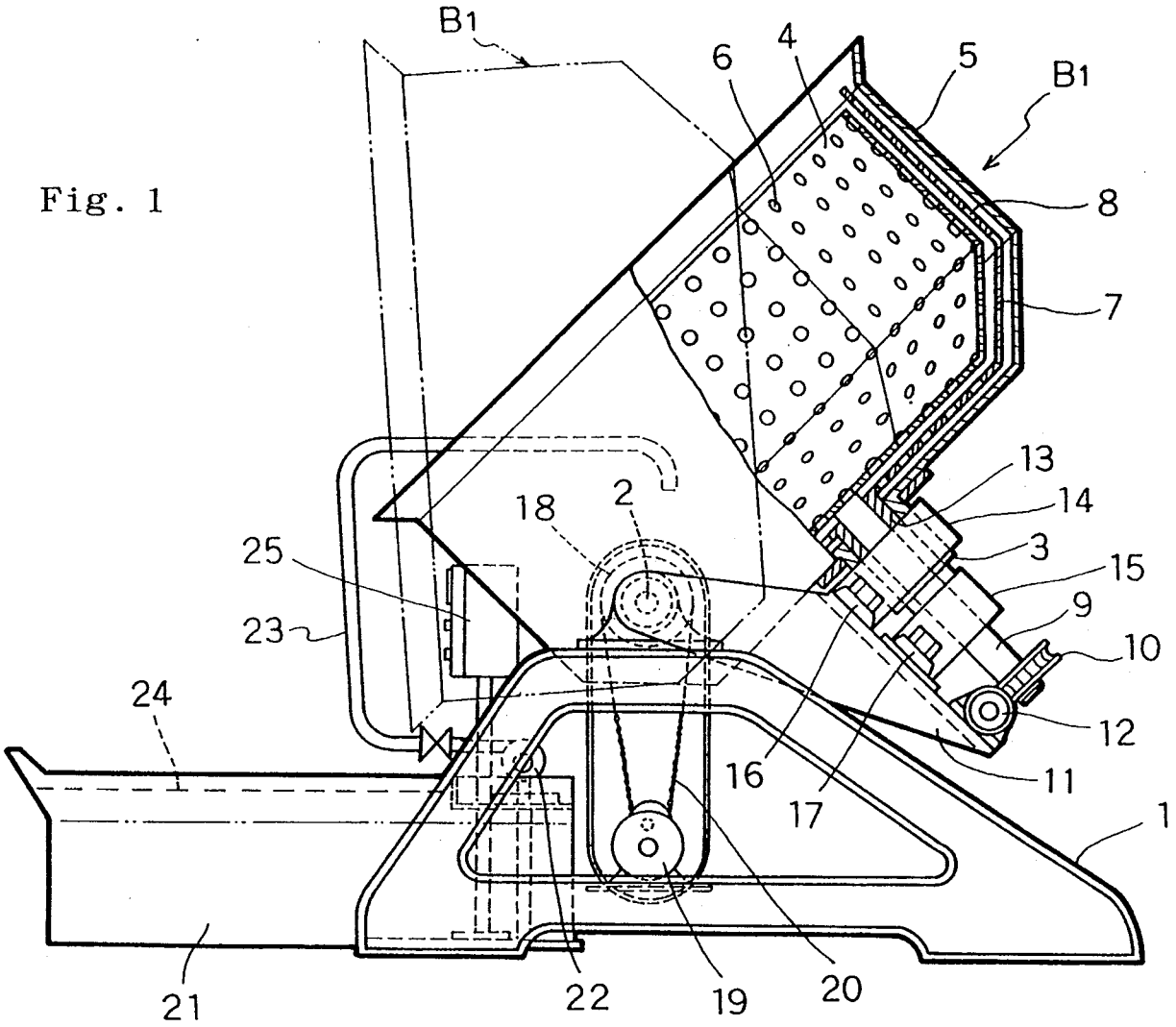
FIG. 1 is a partially exploded sectional view of the surface treatment apparatus of a first embodiment in accordance with the invention.

FIG. 1 illustrates a first embodiment of the invention. In the first embodiment, the invention is applied to a barrel polishing apparatus. Reference numeral 1 designates a base of the barrel polishing apparatus. A tilting shaft 2 is mounted on the base 1 and a support bracket 3 is mounted on the tilting shaft 2 so that a barrel container B1 is usually supported in a tilted position. The barrel container B1 comprises an inner container 4 into which workpieces, electrolyte and media, if necessary are put and an outer container 5 enclosing the inner container 4. The inner container 4 serves as an anode and the outer container 5 serves as a cathode, as will be described later.

The inner container 4 is formed of a stainless steel into a cylindrical shape with an upper open end and a bottom. The inner container 4 has a number of through holes 6 formed in its entire circumference by way of punching. The stainless steel is exposed at the inside of the inner container 4 while its entire outside is covered by a paint film by way of masking. Although the inner container 4 is formed of the stainless steel, it may be formed from another high corrosion resistant and insoluble materials such as titanium, zirconium, niobium or the like.

The outer container 5 is also formed of the stainless steel into a cylindrical shape with an upper open end and a bottom, as in the inner container 4. The outer container 5 has a diameter slightly larger than that of the inner container 4 such that it is enclosed in the outer container 5 coaxially with a substantially uniform gap therebetween. An electrically insulating member 7 is disposed in the gap between the inner and outer containers 4, 5. The insulating member 7 is formed from an insulative material or a heat-resistant resin such as teflon and has an upper open end and a bottom. The insulating member 7 has a number of through apertures 8 formed in its entirety so that the inner and outer containers 4, 5 communicate with each other via the holes 8. Consequently, an electric circuit is made between the electrolyte and the cathode container (the outer container 5) and the anode container (the inner container 4) in the case of electrolytic polishing.

A rotational shaft 9 extends from the central underside of the inner container 4 along the axis thereof. A worm wheel 10 is mounted on the distal end of the rotational shaft 9 and is coupled with a drive motor 12 fixed on the support bracket 11 so that the inner container 4 is rotated at a low speed together with the insulating member 7 and the outer container 5 coaxially therewith. The rotational shaft 9 extends at one end through another insulating cylindrical member 13 integrally extending from the underside of the insulating member 7 coaxially therewith. A seal is applied between the rotational shaft 9 and the insulating cylindrical member 13. Furthermore, the insulating cylindrical member 13 is inserted through a connection pipe 3 projecting from the central underside of the outer container 5 and is further mounted on a first bearing member 14 fixed to the support bracket 11. The rotational shaft 9 is rotatably mounted on a second bearing member 15 which is fixed to the support bracket 11 and located between the first bearing member 14 and the worm wheel 10. A cathode terminal 16 is mounted on the first bearing member 14 and an anode terminal 17 is mounted on the second bearing member 15. Both terminals 16, 17 are connected to a DC power source (not shown). Consequently, the inner container 4 serves as an anode and the outer container 5 serves as a cathode.

A sprocket 18 is mounted on the tilting shaft 2 and linked via a chain 20 with a tilting motor 19 secured on the base 1 so that the barrel container B1 is tilted between a tilted or working position as shown by sol id line in FIG. 1 and a rotated or discharge position as shown by two dot chain line in FIG. 1.

An electrolyte container 21 is positioned below the upper opening of the barrel container B1. A quantity of electrolyte is reserved in the electrolyte container 21 and pumped up by a feed pump 22 to feed the electrolyte into the barrel container B1 through a feed pipe 23 during the polishing operation. The electrolyte overflowing the barrel container B1 is recycled into the electrolyte container 21. A wire netting 24 covers an upper opening of the electrolyte container 21 so that the treated workpieces are isolated from the contents or mass, discharged from the barrel container 21 upon completion of the polishing operation. A control box 25 is provided for operating the barrel container B1 and the feed pump 22.

In the embodiment, the anode and cathode, that is the distance between the inner and outer containers 4, 5 is set to be as small as the insulating member 7 is allowed to be interposed between the inner and outer containers 4. 5. The reason for this is that a current value for the workpieces can be effectively increased by setting the anode-cathode distance at a small value even when the supplied voltage is low.

The operation of the barrel polishing apparatus will now be described. Upon operation of the control box 25, the inner and outer containers 4, 5 are energized and the drive motor 12 is driven to rotate the inner container 4 at the low speed. The workpieces contained in the inner container 4 are physically polished by electrically conductive polishing material such as carbon granules and the like contained in the inner container 4 with the workpieces. Simultaneously, the workpieces are chemically polished by the action of electrolytic polishing. The conductive polishing material is not necessarily required in the electrolytic polishing. More specifically, the workpieces in contact with the inner wall of the inner container 4 becomes the anode since the inner container 4 serves as the anode. Accordingly, the surfaces of the workpieces are electrolytically polished by the action of anodic dissolving. Upon lapse of a predetermined polishing period of time, the tilting motor 19 is energized to rotate the barrel container B1 and to displace it to the discharge position. The contents in the inner container 4 are caused to fall down into the electrolytic container 21 through the metal net 24. Only the workpieces are sorted to be taken out.

Figure 9:
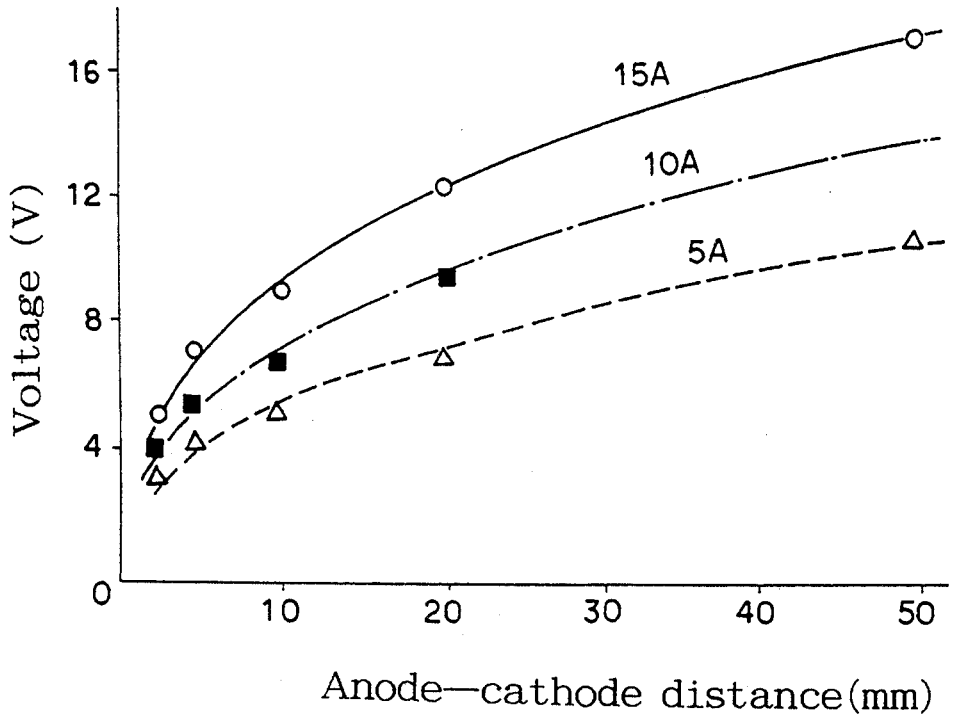
FIG. 9 is a graph showing the relation between the anode-cathode distance and the applied voltage and current.

FIG. 9 shows the results of an experiment made by the inventors about the relation between the anode-cathode distance and the supplied voltage and current in the electrolytic action. In the experiment, each electrode was formed from a material, SUS304 in Japanese industrial standard, and the relation between the voltage and current under the electrolytic action of a salt solution was examined. FIG. 9 shows that the voltage rapidly drops when the anode-cathode distance is reduced to about 10 mm and that a relatively large current value can be obtained even when the voltage is low. On the basis of the experimental results, the barrel container B1 comprises the inner container 4 serving as the anode and the outer container 5 serving as the cathode and enclosing the inner container 4 such that the barrel container B1 is formed into a double container construction. Consequently, the distance between the inner and outer containers 4, 5 or the distance between the anode and cathode can be reduced as short as possible. The anode-cathode distance is about 5 mm long in the first embodiment.

The inventors then examined the degree of polishing by use of the apparatus of the first embodiment and sample pieces formed by stamping out the material, SUS304 and each having the dimensions of 10 mm×50 mm×3 mmt. TABLES 1 and 2 show the results of the examination under different conditions of measurement. In each condition of measurement, a mixture of $H_2SO_4$ and $H_3PO_4$at a weight ratio of 6:4 was used as an electrolyte and the experiment was initiated when the temperature of the electrolyte was 30° C. The inner and outer containers of the barrel polishing apparatus was energized for ten minutes. TABLE 1 shows the results in the case where a constant current of 10 A was supplied and TABLE 2 shows the results in the case where a constant voltage of 5 V was supplied. In each TABLE, "Reduced weight" refers to the reduced weight (mg) of the workpieces per 10 $cm^2$ and "Deburring-/Radius" refers to the radius of an edge section formed when a burr on the edge of the workpiece is electrolytically removed to be rounded. The degree of polishing is high as "Radius" takes a larger value. TABLES 1 and 2 show that improvement in the degree of polishing and deburring can be enhanced by reduction of the anode-cathode distance when either the voltage or the current is maintained at the constant value. Furthermore, generation of a Joule's heat can be restrained since an amount of consumed power is small. Additionally, the electrolyte is continuously fed into the barrel container B1 from the electrolyte container 21 by the feed pump 22. Consequently, the electrolyte can be maintained at a temperature value which does not require forced cooling.

TABLE 1

Anode-cathode distance and degree of polishing in the case of constant current of 10A

| Anode-cathode distance (mm) | Reduced weight (mg/10cm²) | Deburring/Radius (R,mm) initial burr:0.02 mm |
|---|---|---|
| 20.0 | 607.0 | 0.013 |
| 10.0 | 714.2 | 0.018 |
| 5.0 | 815.9 | 0.046 |

TABLE 2

Anode-cathode distance and degree of polishing in the case of constant voltage of 5 V

| Anode-cathode distance (mm) | Reduced weight (mg/10cm²) | Deburring/Radius (R,mm) initial burr:0.02 mm |
|---|---|---|
| 20.0 | 91.4 | 0.025 |
| 10.0 | 110.2 | 0.025 |
| 5.0 | 187.3 | 0.030 |

In the first embodiment, as described above, the stainless steel is exposed at the inside of the inner container 4 while its entire outside is covered by the paint film by way of masking. Without the masking of the paint film, the outer face of the inner container 4 opposite the outer container 5 would be subjected to the influence of the electrolytic action but the workpieces would not be subjected to the electrolytic action. However, an experiment has confirmed that provision of the abovedescribed masking can achieve further efficient deburring and high degree of polishing.

Figure 2:
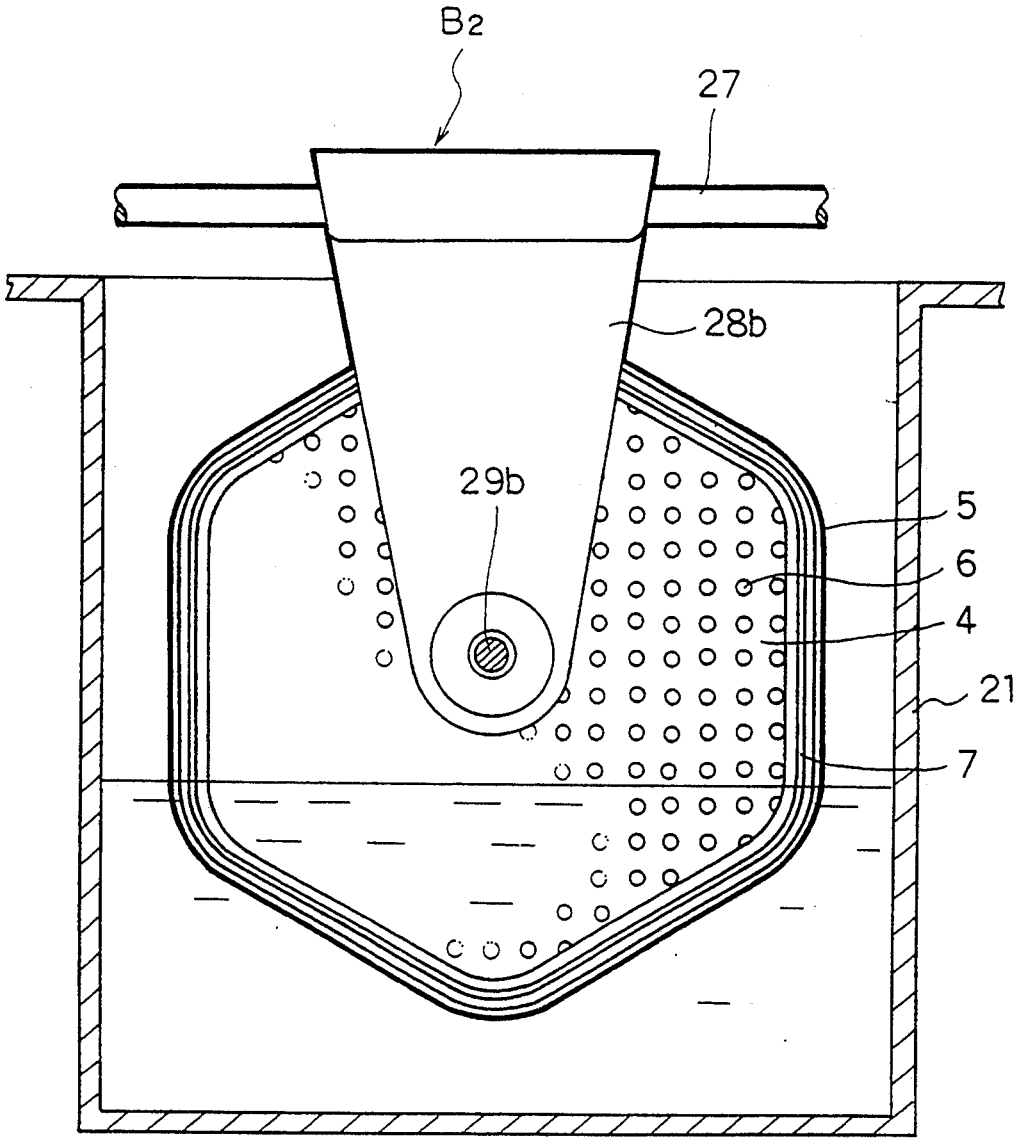
FIG. 2 is a side sectional view of the container of a barrel polishing apparatus of a second embodiment.
Figure 3:
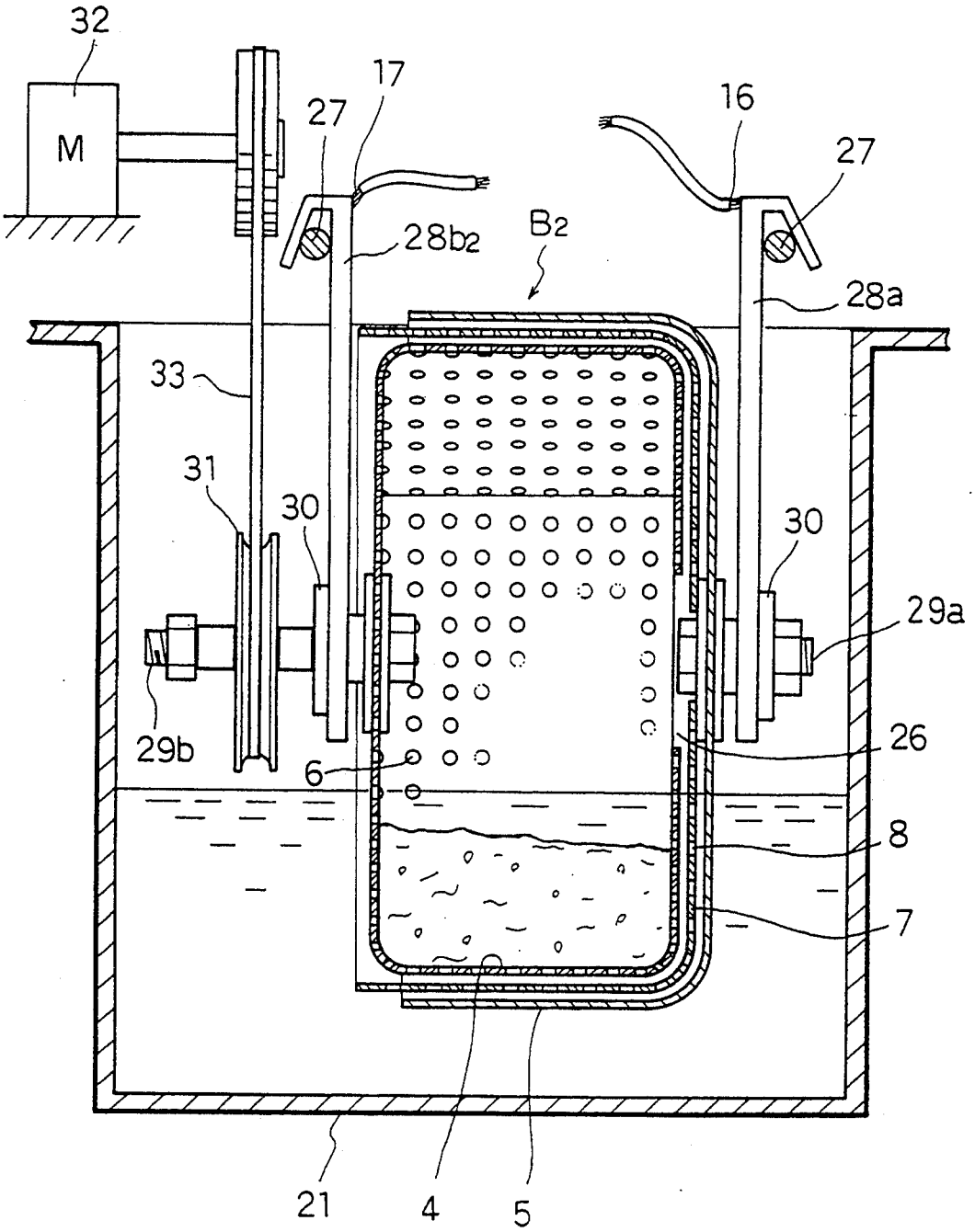
FIG. 3 is a front sectional view of the barrel polishing apparatus.

FIGS. 2 and 3 illustrate a second embodiment of the invention. A barrel container B2 of the barrel polishing apparatus of the second embodiment has the double container construction including the inner and outer containers 4, 5, as in the first embodiment. The inner container 4 is formed into the cylindrical shape and has a number of through holes 6 formed in its entire circumference. The inner container 4 has an access opening 26 formed in its central right-hand side wall, as viewed in FIG. 3. The workpieces and media, if necessary are put into and taken out of the inner container 4 through the access opening 26. The outer container 5 has the depth approximately same as the width of the inner container 4. The outer container is open at one side (at the left-hand side in FIG. 3) and formed into the cylindrical shape. The outer container 5 encloses the inner container 4 coaxially with the gap therebetween. The insulating cylindrical member 7 is disposed between the inner and outer containers 4, The insulating cylindrical member 7 has a number of through apertures 8 formed in its entirety.

Two support wires 27 are provided above the electrolyte container 21 for suspending the barrel container B2. Upper ends of suspending pieces **28*a* and 28*b* each formed of a conductive material such as copper are hung on the support wires 27 respectively. The suspending pieces 28*a*, 28*b* are rotatably and detachably connected at the lower ends to support shafts 29*a* and 29*b* protruding into the central portions of the sides of the containers 4, 5 opposed to each other, via respective bearings 30. The anode terminal 17 is connected to the suspending piece 28*b* adjacent to the inner container 4. The cathode terminal 16 is connected to the suspending piece 28*a* adjacent to the outer container 5. Consequently, the inner container 4 serves as the anode container and the outer container 5** as the cathode container. The barrel container B2 is suspended so that the contents therein are fully immersed in the electrolyte.

A pulley 31 is mounted on the support shaft **29*b* at the side of the inner container 4. The pulley 31 is coupled through a belt 33 with a drive motor 32 disposed outside the electrolyte container 21** such that the barrel container B2 is rotated at the low speed. The recirculation device for the electrolyte are eliminated in the figures.

The other construction of the barrel polishing apparatus of the second embodiment is the same as that in the first embodiment and accordingly, the same effect can be achieved in the second embodiment as in the first embodiment. When the workpieces are put into and taken out of the barrel container B2, it is disconnected from the support wires 27 and thereafter, the inner and outer containers 4, 5 are separated from each other. In this state, the workpieces are put into and taken out of the inner container 4.

Figure 4:
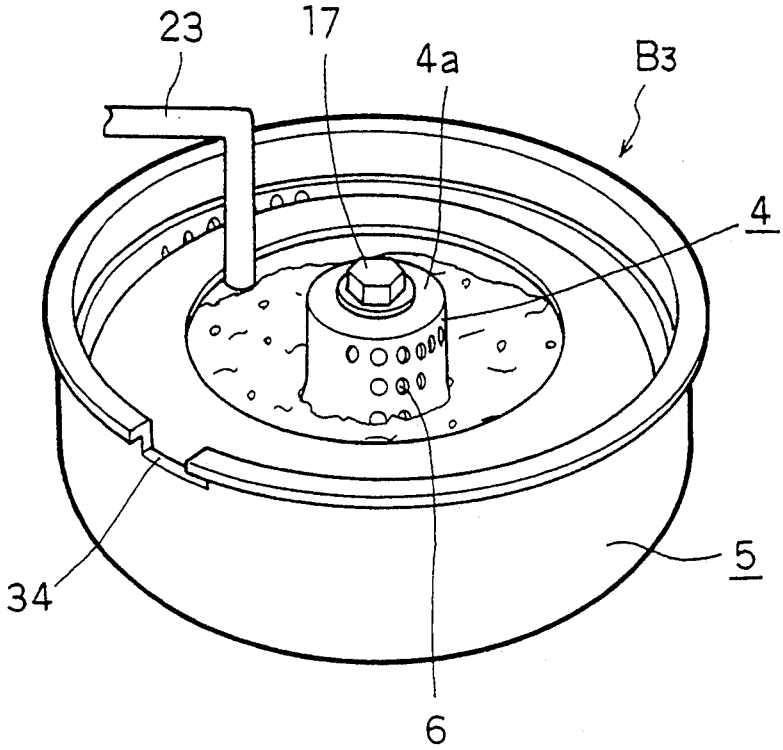
FIG. 4 is a perspective view of a barrel polishing apparatus of a third embodiment.
Figure 5:
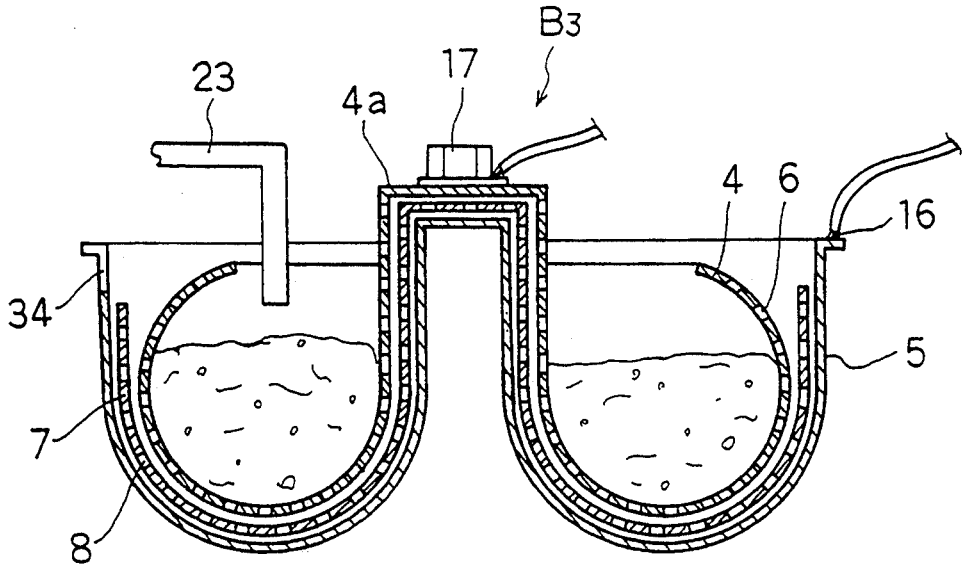
FIG. 5 is a sectional view of the barrel polishing apparatus.

FIGS. 4 and 5 illustrate a third embodiment. In the third embodiment, the invention is applied to a so-called bowl or donut-shaped vibratory barrel polishing apparatus. The outer container 5 of a barrel container B3 has an annular shape and a central upwardly protuberant portion. The inner container 4 is formed to be fitted for the outer container 5 and has a central protuberant portion 4*a*. The inner container 4 is fitted into the outer container 5 along its inner wall with a small gap therebetween. The inner container 4 has a number of through holes 6 formed in its whole except an upper face of the protuberant portion 4*a*. The cathode terminal 16 is mounted on the outer container 5 and the anode terminal 17 on the protuberant portion 4*a* of the inner container 4 so that the outer container 5 serves as the cathode and the inner container 4 as the anode. The insulating member 7 formed from the insulative material is disposed between the inner and outer containers 4, 5. The insulating member 7 has a number of throgh holes 8 formed in its whole.

A distal end of the feed pipe 23 connected to the feed pump (not shown) faces the upper opening of the barrel container B3 so that the electrolyte is fed into the inner container 4 during the polishing. An overflow hole 34 is formed by cutting off a portion of the outer peripheral wall of the outer container 5 so that the electrolyte overflows therethrough. The overflowed electrolyte is returned into the circulation container (not shown) and then, pumped up by the feed pump to be recirculated. The barrel container B3 is connected to a vibratory source (not shown).

The other construction of the barrel polishing apparatus of the third embodiment is the same as that in the first embodiment and accordingly, the same effect can be achieved in the second embodiment as in the first embodiment.

Figure 6:
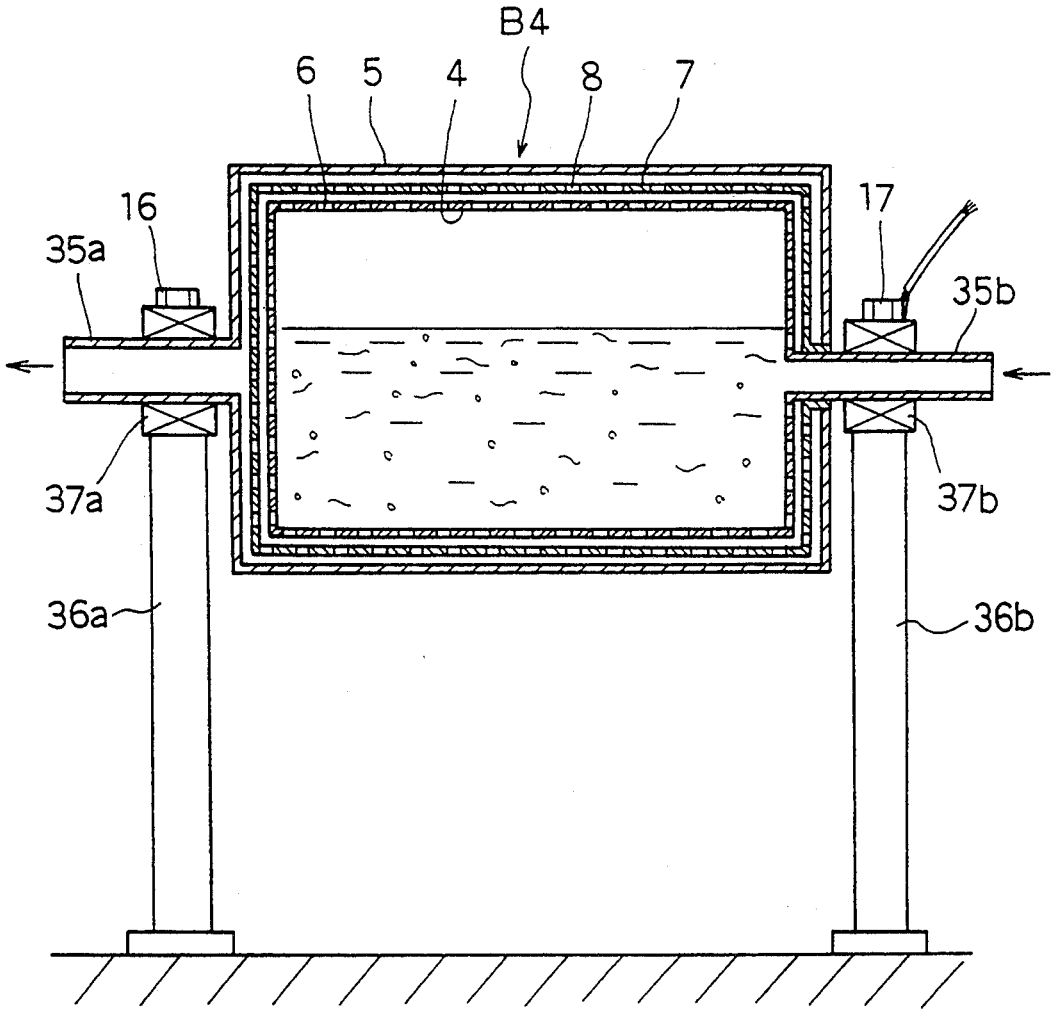
FIG. 6 is a front sectional view of a barrel polishing apparatus of a fourth embodiment.

FIG. 6 illustrates a fourth embodiment. In the fourth embodiment, the invention is applied to an enclosed rotary barrel polishing apparatus. In a barrel container B4 of the barrel polishing apparatus, a support shaft 35*a* projects axially from the central portion of the one side thereof (the left-hand side in FIG. 6). the support shaft 35*a* is rotatably mounted on a bearing 37*a* which is further mounted on a support 36*a*. A support shaft 35*b* projects axially from the central portion of one side of the inner container 4 water-tightly against the insulating member 7 and the outer container 5. The support shaft 35*b* is rotatably mounted on a bearing 37*a* which is further mounted on a support 36*b*. The inner container 4 is coaxially enclosed in the outer container 5 with the small gap therebetween. The inner container 4 has a number of through holes 6 formed in its whole.

The cathode terminal 16 is connected to the bearing 37*a* at the side of the outer container 5 and the anode terminal 17 is connected to the bearing 37*b* at the side of the inner container 4 so that the outer container 5 serves as the cathode and the inner container 4 as the anode. The support shaft 35*b* is connected to the feed pump (not shown) so that the electrolyte is fed into the inner container 4 therethrough during the polishing. The support shaft 35*a* is provided for recovering the electrolyte-overflowed from the inner container 4, into the recirculation containers (not shown). A lid is detachably mounted on the barrel container B4 to open and close openings of the inner and outer containers 4, 5 and the insulating member so that the workpieces are put into and taken out of the inner container 4 through the opening. The other construction of the apparatus of the fourth embodiment is the same as that in the first, second or third embodiment and accordingly, the same effect can be achieved in the fourth embodiment as in the foregoing embodiments.

Figure 7:
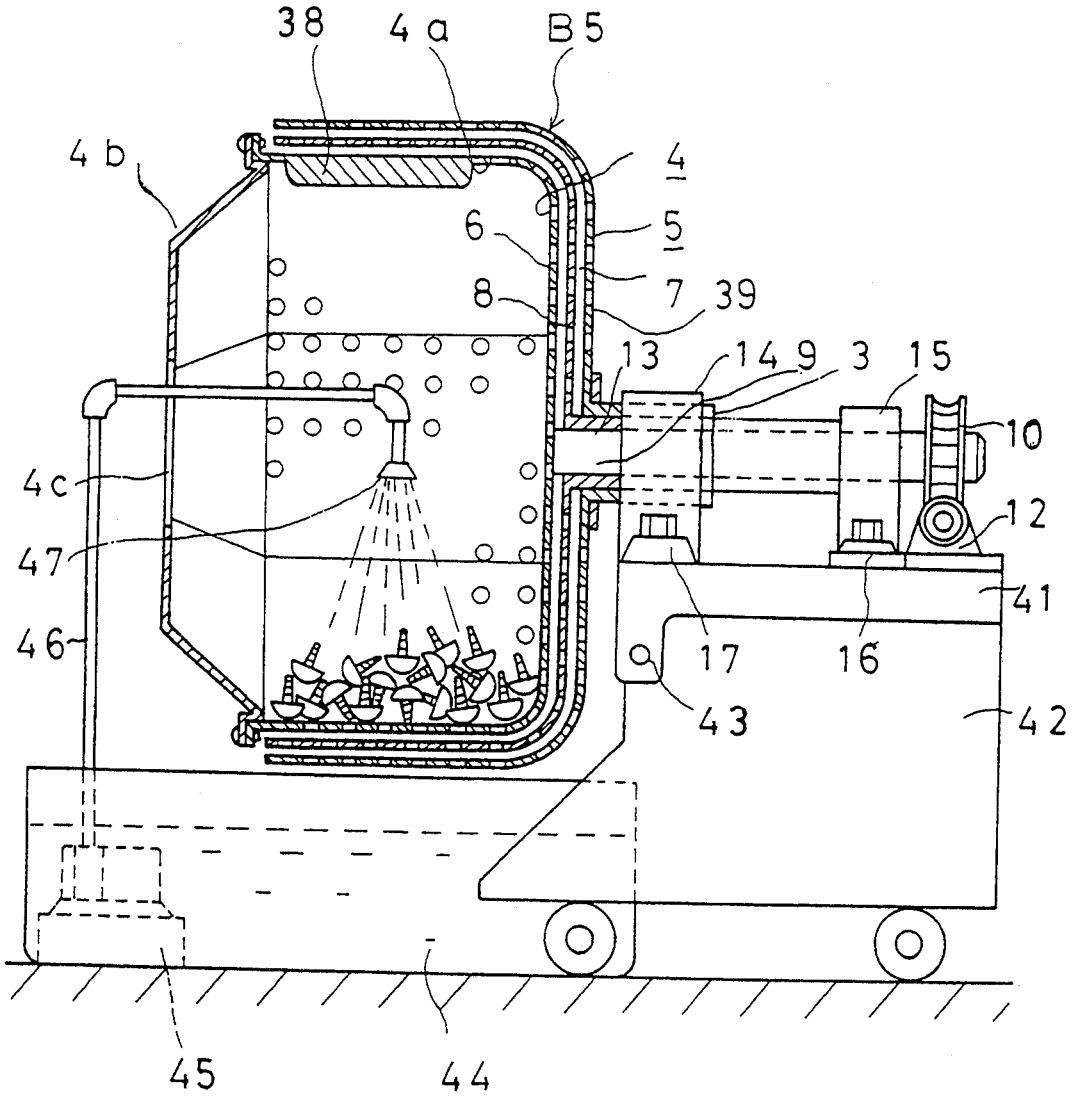
FIG. 7 is a front view of an electroplating apparatus of a fifth embodiment.
Figure 8:
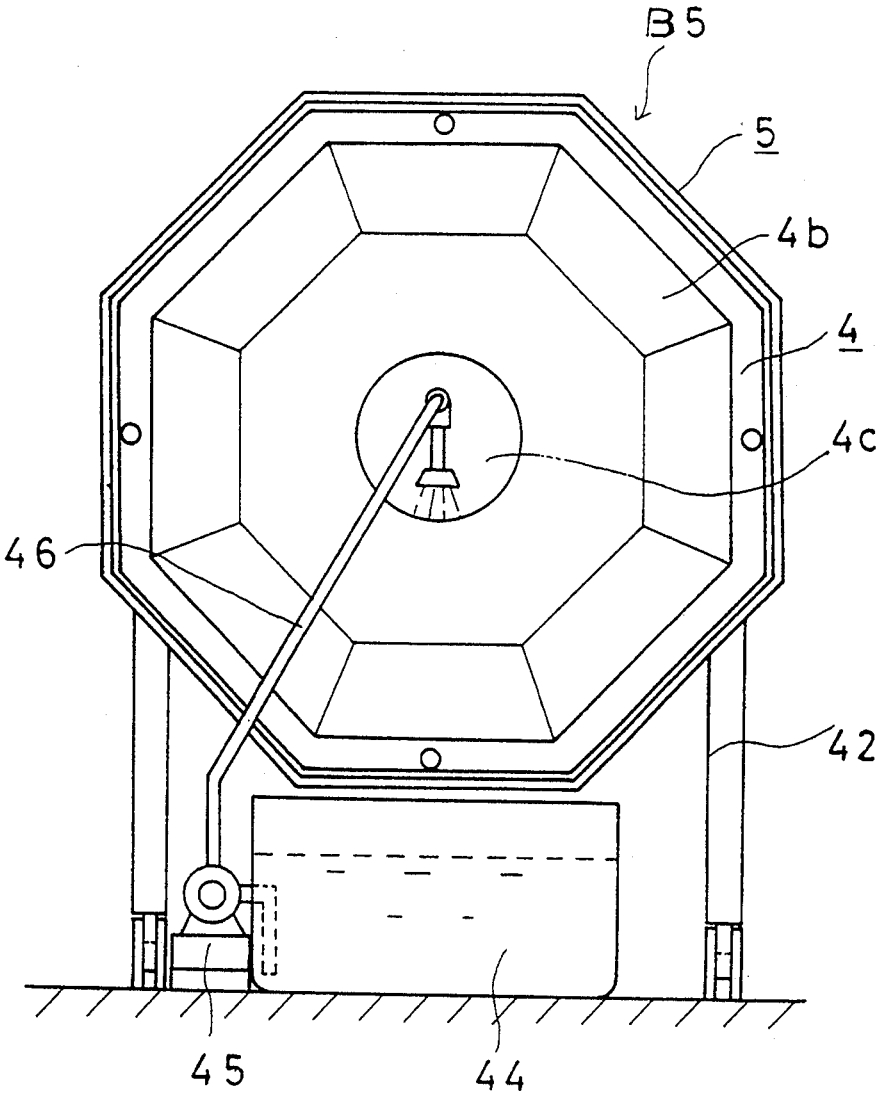
FIG. 8 is a side view of the electroplating apparatus.

FIGS. 7 and 8 illustrate a fifth embodiment. The invention is applied to an electroplating apparatus having a barrel container in the fifth embodiment. The barrel container B5 employed in the electroplating apparatus has the double container construction as described above with a difference that the inner container 4 serves as the cathode and the outer container 5 as the anode.

The inner container 4 formed of the stainless steel includes a generally octagonal cylindrical body 4*a*. A cover 4*b* is detachably mounted on a distal end of the body 4*a* by bolts and nuts for preventing the electrolyte scattering. The cover 4*b* has a central opening 4*c* through which a pipe for feeding the electrolyte is inserted and pulled out. A number of through holes 6 are formed in the whole side of the body 4*a* of the inner container 4. A plurality of ribs 38 formed from titanium project from the inner wall of the body 4*a*. Six such ribs 38, for instance, are formed at equal angular intervals in the embodiment and only one of them is shown in FIG. 7. The ribs 38 are provided for enhancing agitation of the workpieces and for increasing a contact area between the container wall and workpiece.

The outer container 5 formed of the stainless steel is fitted with the inner container 4 to surround the body 4*a* thereof with the small gap (about 5 mm wide) therebetween. The insulating member 7 formed from the heat resistant resin such as teflon is disposed between the inner and outer containers 4, 5. The insulating member 7 has a number of through holes 8 formed in its whole so that the inner and outer containers 4, 5 communicates with each other by the electrolyte through the holes 8. A number of through holes 39 are formed in the side wall of the outer container 5.

The rotational shaft 9 extends from the central underside of the inner container 4 through the insulating member 7 and the outer container 5 coaxially with them. The rotational shaft 9 is rotatably mounted on the first and second bearings 14, 15 provided on a support plate 41. A worm wheel 10 is mounted on an end of the rotational shaft 9. The worm wheel 10 is coupled with the drive motor 12 mounted on the support plate 41 such that the inner container 4 is rotated at the low speed with the member 7 and the outer container 5. The rotational shaft 9 extends at one end through another insulating member 13 integrally extending from the underside of the insulating member 7 coaxially therewith. A seal is applied between the rotational shaft 9 and the insulating cylindrical member 13. Furthermore, the insulating cylindrical member 13 is inserted through the connection pipe 3 projecting from the central underside of the outer container 5 and is further mounted on the first bearing member 14. The anode terminal 17 is mounted on the first bearing member 14 and the cathode terminal 16 is mounted on the second bearing member 15. Both terminals 16, 17 are connected to a DC power source (not shown). Consequently, the inner container 4 serves as the cathode and the outer container 5 serves as the anode.

The support plate 41 is placed on a carriage 42 moved in close to and away from the electrolyte feeding pipe and mounted on a rocking shaft 43 mounted on the support plate 41, so as to be inclined. Locking means (not shown) is mounted on the rocking shaft 43 so that the support plate 41 or the barrel container B5 is usually held in a horizontal position. The barrel container is inclined forward for the discharge of the workpieces when the locking is released upon completion of the working. Although the barrel container is manually inclined in the embodiment, it may be coupled with an electric motor or the like so that it is mechanically inclined.

A recovery container 44 is disposed in front of the carriage 42 to receive the electrolyte flowing out of the barrel container. A recirculation pump 45 is disposed outside the recovery container 44 to pump up the electrolyte in the barrel container. A feeding pipe 46 is connected to an outlet of the pump 45. The distal end of the pipe 46 is inserted into the interior of the inner container 4 through the opening 4*c* of the cover 4*b*. A shower 47 is mounted on the distal end of the pipe 46 so that the electrolyte is showered onto the workpieces in the inner container 4.

The electrolyte used in the apparatus of the embodiment may contain ions of a metal to be electroplated on the workpieces. In the electroplating, the workpieces are put into the barrel container held in the horizontal position. Then, the drive motor 12 is driven to rotate the inner container 4, together with outer container 5 and insoluting member 7 at the low speed while the recirculation pump 45 is driven to pump up the electrolyte in the recovery container 44 so that the electrolyte is showered onto the workpieces. In this case, since the outer container 5 serves as the anode and the inner container 4 as the cathode, the workpieces in contact with the inner container 4 serve as the cathode.

In the fifth embodiment, too, the impedance between the anode and cathode is small since the gap between the inner and outer containers 4, 5 or the anode-cathode distance is small. Accordingly, a large current value can be obtained even when the applied voltage is low. Additionally, the electrolyte is showered onto the workpieces even though the workpieces are not immersed in the electrolyte. Accordingly, since part of the workpieces are bathed in the electrolyte, a current density per unit area is increased as compared with the case where the workpieces are immersed in the electrolyte. Consequently, the electrolytic action in the electrolyte is enhanced, which can provide for lustrous electroplated articles in a short period of time.

Furthermore, since the ribs 38 are formed on the inner wall of the inner container 4, the electrolyte can be uniformly showered onto the workpieces by the agitation due to rotation of the barrel container or the inner container 4 during the treatment. Additionally, the contact resistance can be reduced due to the increase in the contact area with the workpieces. The other construction of the apparatus of the fifth embodiment is the same as that in each of the foregoing embodiments and accordingly, the same effect can be achieved in the fifth embodiment as in the other embodiments.

The electroplating apparatus of the fifth embodiment may be diverted to an apparatus for the electrolytic polishing and the electrolytic polishing apparatus of each of the first to fourth embodiments may be diverted to an apparatus for the electroplating. Furthermore, the invention may be applied to a centrifugal barrel polishing apparatus in addition to those of the above-described types. Although the DC power source is employed as the source for the electrolytic treatment in the foregoing embodiments, a DC pulse wave current may be employed instead. The inventors have confirmed that deburring, polishing and electro plating efficiency can be improved in the use of the pulse wave current as compared with those in the use of the DC power source.

Various other changes to the invention may be made without departing from the spirit of the invention as defined in the following claims.

We claim:

1. A surface treatment apparatus for workpieces, comprising:

a) an electrically conductive inner container for containing workpieces, the inner container having a number of holes formed in a circumferential wall thereof so that an electrolyte supplied to the workpieces passes through the holes;

b) an electrically conductive outer container disposed to surround the inner container coaxially therewith with a small gap therebetween;

c) a pair of electrode terminals connected to the inner and outer containers respectively so that the containers serve as electrodes with polarity opposite each other, respectively;

d) an insulator interposed between the inner and outer containers with a gap between the same and each container; and e) a drive source supplying a rotational or vibratory force to the inner container.

2. A surface treatment apparatus according to claim 1, wherein the outer container is a reservoir for the electrolyte.

3. A surface treatment apparatus according to claim 1, wherein the outer container is formed so as to pass the electrolyte therethrough.

4. A surface treatment apparatus according to claim 1, and further comprising an electrolyte container in which both of the inner and outer containers are disposed.

5. A surface treatment apparatus according to claim 1, further comprising electrolyte supply means for showering the electrolyte on the workpieces.

6. A surface treatment apparatus according to claim 1, further comprising a container for reserving recovered electrolyte and a recirculation system for pumping the electrolyte reserved in the container to supply the same to the inner container.

7. A surface treatment apparatus according to claim 1, wherein the inner container serves as an anode and the outer container serves as a cathode.

8. A surface treatment apparatus according to claim 1, wherein the inner container serves as a cathode and the outer container serves as an anode.

9. A surface treatment apparatus according to claim 1, wherein the gap between the inner and outer containers is 10 millimeters long or less.

10. A surface treatment apparatus according to claim 1, wherein the inner container is connected to a drive motor for rotation about an axis of the apparatus.

11. A surface treatment apparatus according to claim 1, wherein the inner container is connected to a vibration source.

12. A surface treatment apparatus according to claim 1, wherein the inner container has an electrically conductive rib formed on the inner wall thereof to project therefrom.

* * * * *